US005259343A

United States Patent [19]

Cone, II et al.

[11] Patent Number: 5,259,343

[45] Date of Patent: Nov. 9, 1993

[54] APPARATUS FOR PROVIDING UNIFORM HEAT TRANSFER IN SUPERHEATING STEAM GENERATORS

[75] Inventors: Howard M. Cone, II, Rochester; Dickie A. Van Der Lyke, Williamson, both of N.Y.

[73] Assignee: Rochester District Heating Cooperative, Rochester, N.Y.

[21] Appl. No.: 961,419

[22] Filed: Oct. 15, 1992

[51] Int. Cl.[5] ..... F22G 7/14

[52] U.S. Cl. ..... 122/473; 122/331; 122/472; 122/474; 122/478

[58] Field of Search ..... 122/331, 349, 473, 474, 122/478, 472, 460

[56] References Cited

U.S. PATENT DOCUMENTS

| | | | |
|---|---|---|---|
| 94,767 | 9/1869 | Phleger . | |
| 169,977 | 11/1875 | Firmenich et al. . | |
| 392,986 | 11/1888 | Brown . | |
| 669,287 | 3/1901 | Shilling . | |
| 686,719 | 11/1901 | Ernst . | |
| 972,580 | 10/1910 | Sherman . | |
| 1,413,863 | 4/1922 | Maddocks . | |
| 1,672,455 | 6/1928 | Gosse . | |
| 1,832,769 | 11/1931 | Graham | 122/473 X |
| 2,123,860 | 7/1938 | Blizard | 122/478 |
| 2,287,961 | 6/1942 | Barnes | 122/473 |
| 2,368,633 | 2/1945 | Blizard | 122/473 |
| 3,736,907 | 6/1973 | Agrest . | |

*Primary Examiner*—Edward G. Favors
*Attorney, Agent, or Firm*—Cumpston & Shaw

[57] ABSTRACT

A superheated steam generator having superheating steam tubes and boiler tubes fluidly connected to a boiler, wherein the steam tubes and boiler tubes extend, intermediate of a heat source and the boiler. Localized insulation is located adjacent the superheating steam tubes and intermediate of the boiler and the heat source to reduce heat transfer to the boiler in the region of the superheating steam tubes. To prevent local roiling within the boiler, the thermal resistance of the local insulation and the superheating steam tubes is substantially equal to the thermal resistance of the boiler tubes.

5 Claims, 2 Drawing Sheets

APPARATUS FOR PROVIDING UNIFORM HEAT TRANSFER IN SUPERHEATING STEAM GENERATORS

The present invention relates to steam generators, more particularly, to a superheating steam generator configured to provide substantially uniform heat transfer to a boiler drum.

BACKGROUND OF THE INVENTION

U.S. Pat. No. 669,287 to Shilling discloses a horizontal boiler having longitudinal supporting brick work beneath the boiler wherein the brick contacts the sides of the boiler, thereby providing a space between the boiler and the brick. An asbestos or mineral wool filling is disposed in the space. The asbestos or mineral wool forms a cushion to counteract the expansion of the boiler and the supporting brick arch and to prevent flue dust from accumulating between the boiler and the brick work.

U.S. Pat. No. 169,977 to Firmenich et al. discloses a sectional boiler having rows of vertical tubes connecting a series of steam and water drums.

SUMMARY OF THE INVENTION

The present invention includes a superheating steam generator configured to provide a substantially uniform heat transfer from a heat source to a boiler. The present invention thereby minimizes localized roiling within the boiler and substantially reduces carryover to the superheating tubes.

The steam generator of the present invention includes a boiler having first and second set of fluid transporting tubes fluidly connected to the boiler. A length of the first and second set of tubes and a portion of the boiler are thermally exposed to a heat source, wherein a portion of the first and second tubes extends between the heat source and the boiler.

Water is passed through the first set of tubes and steam is passed through the second set of tubes. Under the operating conditions, the first set of tubes has a higher thermal resistance than the second set of tubes. The present invention includes means for locally reducing the heat transfer from the heat source to the boiler in the area of the second set of tubes such that the combined thermal resistance of the local heat reducing means and the second set of tubes is substantially equal to the thermal resistance of the first set of tubes.

DETAILED DESCRIPTION OF THE PREFERRED EMBODIMENTS

Figure 2:
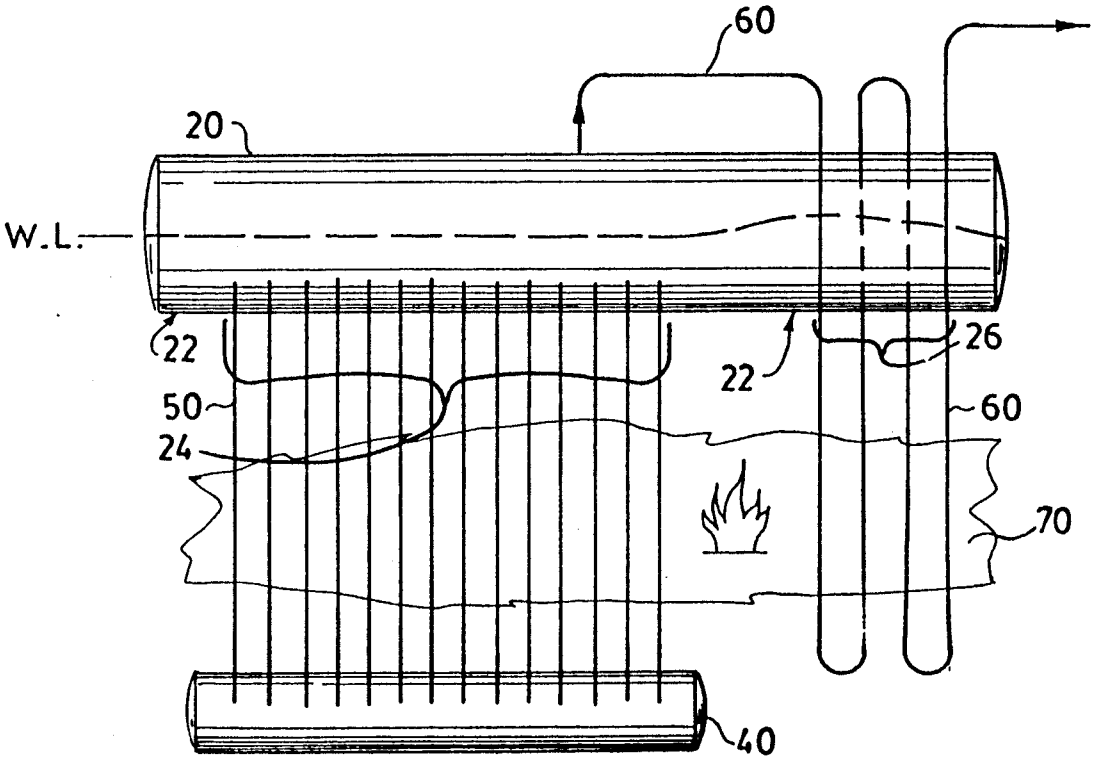
FIG. 2 PRIOR ART
FIG. 2 is a side elevational view of the superheating steam generator shown in FIG. 1.
Figure 1:
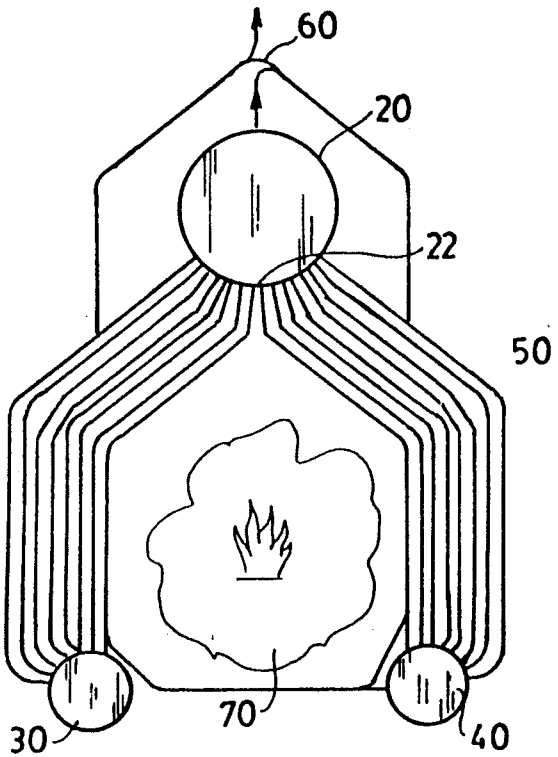
FIG. 1 PRIOR ART
FIG. 1 is a schematic end elevational view of a superheating steam generator.
Figure 3:
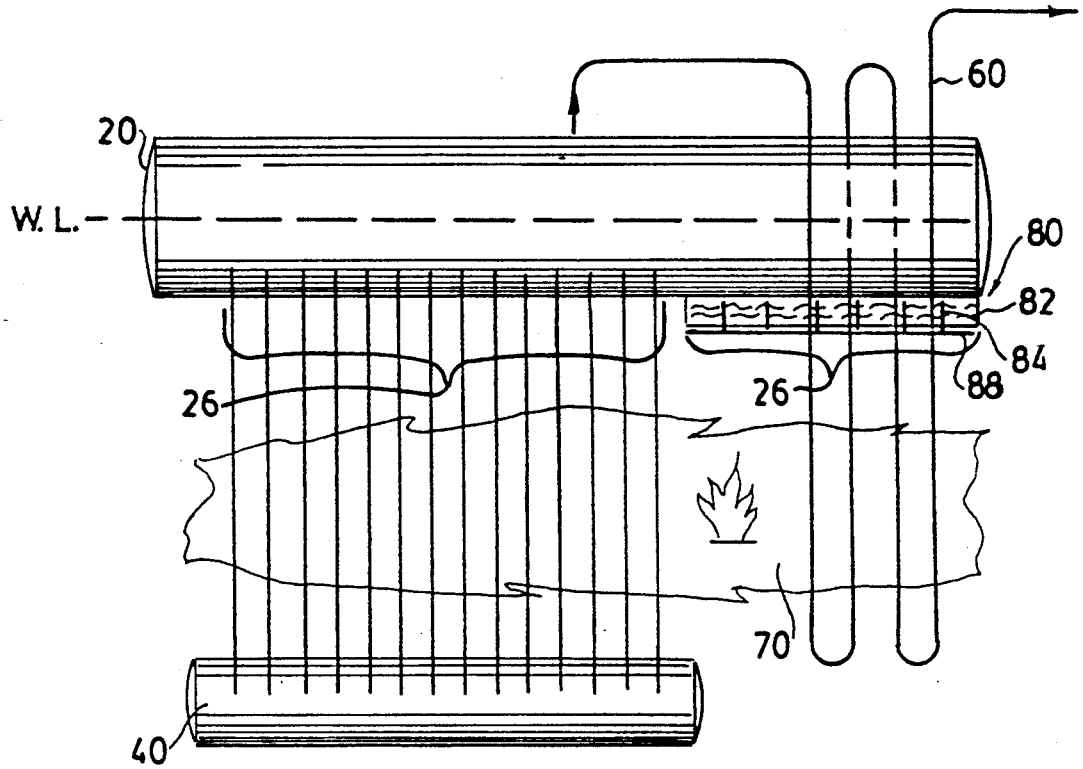
FIG. 3 is a side elevational view of the superheating steam generating system of the present invention.

Referring to FIG. 1, a superheating steam generator 10 is shown. The steam generator 10 includes a main boiler 20, a lower left water drum 30 and a lower right water drum 40. A first set of tubes 50, boiler tubes, are fluidly connected to the boiler 20 and extend downward to fluidly connect to the lower water drums 30,40. The water drums 30,40 are spaced apart such that a heat source 70 may be disposed between the water drums As shown in FIG. 1-3, a portion or length of the boiler tubes 50 is disposed between the boiler 20 and the heat source 70. The water drums 30,40 are spaced apart such that as the heat source 70 is between the water drums the boiler 20 is located over the heat source 70. The heat source 70 thereby heats a heated region 22 of the boiler 20 and a length of the boiler tubes 50. The heat source 70 may be any of the commercially available sources such as coal, oil, gas or wood. In addition, the heat source may have a variety of configurations as well known in the art.

The configuration of the boiler 20, water drums 30,40 and heat source 70 is known in the art as an A-type. However, other types may be employed, such as O or D type. However, the A type boiler having a superheating section is especially applicable to the present invention.

As shown in FIGS. 1 and 2, in addition to the first set of tubes 50, a second set of tubes 60, the superheating tubes, are fluidly connected to the boiler 20 and extend from the top of the boiler to have a length extending between the heat source 70 and the boiler. Therefore, a length of the superheating tubes 60 is thermally exposed to the hear source 70.

For ease of manufacturing, the boiler tubes 50 usually occupy a given length of the boiler 20 and the superheating tubes 60 occupy the remaining length. The length of boiler tubes 50 extending between the heat source 70 and the boiler 20 define a saturated section 24 of the heated region 22. The length of superheating tubes 60 extending between the heat source 70 and the boiler 20 define a superheating section 26 of the heated region 22.

Referring to FIG. 2, the boiler 20 contains chemically treated water which fills a portion of the boiler, to define a water line W.L. The water in the boiler 20 includes dissolved solids and salts for providing optimal efficiency of the boiler. Specifically, the dissolved solids substantially reduce foaming and prevent scaling as well known in the art.

Under optimal operating conditions, when the water in the boiler tubes 50 is exposed to sufficient heat, the water is vaporized to produce steam. The steam consists of substantially pure water vapor, as the dissolved chemicals remain dissolved in the liquid. The introduction of the make-up water to replace the lost volume substantially maintains the desired chemical concentration. This process is well known in the art.

The steam passes from the boiler tubes 50 through the boiler 20 to the superheating tubes 60. The superheating tubes 60 expose the steam to the heat source 70 to ensure that upon export of the steam, the steam remains in the gaseous state.

As shown in FIG. 2, under normal operating conditions, the boiler tubes 50 absorb sufficient thermal energy from the heat source 70 such that the water level in the boiler 20 is substantially level in the saturated section 24. However, the heat transfer capacity of steam in the superheating tubes 60 is much less than water, and therefore, the superheating tubes absorb substantially less thermal energy than the boiler tubes. That is, during operation of the steam generator 10, the thermal resistance of the superheating tubes 60 is less than the boiler tubes 50.

Referring to FIG. 2, the thermal energy not absorbed by the superheating tubes 60 passes by the superheating tubes and is absorbed by the superheating section 26.

The localized exposure of the boiler 20 to excess thermal energy causes localized roiling in the area of the superheating tubes. The roiling locally increases the water level in the boiler 20 creating carryover. That is, water particles become entrained in the steam and are exported to the superheating tubes 60. Therefore, rather than only pure water vapor passing through the superheating tubes 60, water having dissolved chemicals enters the superheating tubes.

Upon passage of the chemically treated water to the superheating tubes 60, the heat in the superheating tubes vaporizes the water, thereby causing the previously dissolved chemicals to plate out, or collect, on the inside walls of the superheating tubes. The plating of chemicals on the superheating tubes 60 further reduces the thermal resistance of the tubes, thereby further increasing the heat transfer to the superheating section 26 of the boiler 20, and further increasing localized roiling. Upon sufficient plating of chemicals in the superheating tubes 60, the tubes themselves may actually melt.

Figure 4:
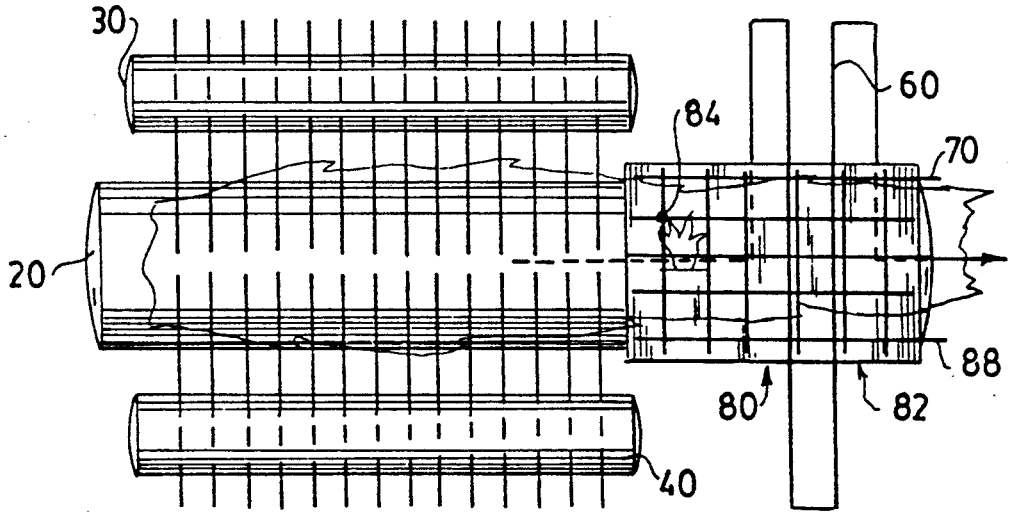
FIG. 4 is a schematic top plan view showing the present invention.

Referring to FIGS. 3 and 4, the present invention includes localized means 80 intermediate of the heat source 70 and the boiler 20, in the area of the superheating tubes 60 for locally reducing the heat transfer to the boiler. Preferably, the means 80 for locally reducing heat transfer to the boiler 20 includes insulation 82 proximal to the fire side of the boiler, such that the insulation 82 is between the superheating tubes 60 and the superheating section 26 of the heated region 22. As shown in FIG. 3 and 4, the insulation 82 is disposed on the fireside of the boiler 20. The insulation 82 may follow a portion of the periphery of the boiler 20 a sufficient distance to substantially preclude localized roiling.

The fireside of the boiler 20 in the heated region 22 is subject to an extremely hostile and aggressive environment. Therefore, it is important that the insulation 82 is securely affixed relative to the boiler 20. Preferably, stainless steel pins 84 extend outward from the fireside of the boiler 20. The insulation 80 is an insulative blanket 82, such as fibrafax manufactured by Plibrico Co. The insulation 80 is punctured by the pins. 84 such that a length of the pins extends beyond the blanket. Washers 86 are affixed to the exposed length of the pins 84 to retain the blanket 82 proximal to the boiler 20. A mesh stainless steel jacket 88 is affixed to the end of the pins 84 to protect the blanket 82 and provide for expansion of the protective jacket when heated.

A variety of other configurations may be used to employ the insulation blanket 82 as the means 80 for locally reducing the heat transfer to the boiler. That is, the insulation 82 may be secured by retainers (not shown), wherein the retainers are fastened to the boiler and include clamps, or clips for engaging the insulation 80.

Therefore, in the superheating section 26, the boiler 20 is not directly exposed to the heat source 70. The superheating section 26 cooperates with the localized means 80 intermediate of the heated region 22 and the heat source 70, and specifically, between superheating tubes 60 and the heated region to reduce thermal transfer from the heat source to the superheating section.

The combined thermal resistance of the insulation 82 and the superheating tubes 60 is sufficient to prevent localized roiling in the boiler 20. As shown in FIG. 3, under operating conditions with the insulation 82, the water level in the boiler 20 is substantially constant. The constant water level prevents carryover and reduces the transfer of water an dissolved chemicals to the superheating tubes 60.

Alternatively, the means 80 for locating reducing heat transfer from the heat source 70 to the superheating section 26 may be performed by a variety of systems including, locally cooling the area with a stream of external air, incorporating cooling tubes or local heat sinks.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed:

1. An apparatus for producing superheated steam, comprising:
   (a) a boiler for retaining a quantity of liquid for conversion to steam;
   (b) a heater for supplying sufficient thermal energy to the boiler for converting a portion of the liquid to steam;
   (c) superheating steam tubes fluidly connected to the boiler and thermally exposed to the heater for raising the thermal content of the steam; and
   (d) localized heat transfer reducing means disposed between the heater and the boiler proximal to the superheating steam tubes for sufficiently inhibiting the local transfer of thermal energy to the boiler to substantially prevent carryover to the superheating steam tubes.

2. An apparatus for producing superheated steam, comprising:
   (a) a boiler for retaining a quantity of liquid to be vaporized:
   (b) heating means for transferring thermal energy to the boiler;
   (c) a plurality of boiler tubes fluidly connected to the boiler, the boiler tubes thermally coupled to the heating means for generating steam in the boiler tubes;
   (d) a plurality of superheating tubes fluidly connected to the boiler, the superheating tubes having a length extending between the heating means and the boiler to thermally couple the heating means to the steam; and
   (e) localized insulation intermediate of the superheating tubes and the boiler for reducing heat transfer to the boiler.

3. In an improved boiler having a first and a second set of fluid transporting tubes extending between the boiler and a heat source, wherein the first set of tubes has a greater thermal resistance than the second set of tubes during operating conditions, the improvement comprising:
   (a) means for locally reducing heat transfer from the heat source to the boiler in the area of the second set of tubes.

4. An apparatus having a furnace plenum for generating superheated steam, comprising:
   (a) a boiler having a heated region thermally exposed to the furnace plenum;
   (b) a plurality of boiler tubes fluidly connected to the boiler and extending from the boiler through the furnace plenum to generate steam;

(c) a plurality of superheating tubes fluidly connected to the boiler and having a length extending through the furnace plenum for conducting steam from the boiler through the furnace plenum; and (d) localized means between the superheating tubes and a portion of the heated region for locally reducing heat transfer to the boiler in the area of the superheating tubes.

5. An apparatus for generating superheated steam, comprising:

(a) a heat source;

(b) a boiler having a heated region exposed to the heat source;

(c) a plurality of boiler tubes fluidly connected to the boiler and having a length extending between the heat source and the heated region;

(d) superheating tubes fluidly connected to the boiler and having a length extending between the boiler and the heat source to overlie a superheating section of the boiler; and (e) localized means between the superheating tubes and the superheating section for substantially precluding roiling in the superheating section of the boiler.

* * * * *